US008919431B2

(12) United States Patent
Lott

(10) Patent No.: US 8,919,431 B2
(45) Date of Patent: Dec. 30, 2014

(54) WELLBORE ANCHORING SYSTEM

(75) Inventor: Charles Lott, Kellyville, OK (US)

(73) Assignee: Cobra Tool, Inc., Houston, TX (US)

( * ) Notice: Subject to any disclaimer, the term of this patent is extended or adjusted under 35 U.S.C. 154(b) by 291 days.

(21) Appl. No.: 13/471,120

(22) Filed: May 14, 2012

(65) Prior Publication Data

US 2013/0299160 A1 Nov. 14, 2013

(51) Int. Cl.
*E21B 19/10* (2006.01)

(52) U.S. Cl.
USPC ..... 166/88.2; 166/382; 166/117.6; 166/217; 166/383; 166/181

(58) Field of Classification Search
USPC ..... 166/88.2, 382, 117.6, 217, 383, 181
See application file for complete search history.

(56) References Cited

U.S. PATENT DOCUMENTS

| | | | |
|---|---|---|---|
| 3,460,617 | A | 8/1969 | Brown et al. |
| 5,566,762 | A | 10/1996 | Braddick et al. |
| 6,076,606 | A | 6/2000 | Bailey et al. |
| 6,360,821 | B1 | 3/2002 | Braddick |
| 6,779,600 | B2 | 8/2004 | King et al. |
| 6,935,431 | B2 | 8/2005 | Dewey et al. |
| 7,377,328 | B2 | 5/2008 | Dewey et al. |
| 7,448,446 | B2 | 11/2008 | Campbell et al. |
| 7,789,134 | B2 | 9/2010 | Harris |
| 7,963,341 | B2 | 6/2011 | Rios, III et al. |
| 2002/0053434 | A1 | 5/2002 | Chen et al. |

FOREIGN PATENT DOCUMENTS

| | | |
|---|---|---|
| GB | 759889 | 10/1956 |
| GB | 846859 | 8/1960 |
| GB | 2246585 | 2/1992 |

OTHER PUBLICATIONS

International Search Report dated Oct. 16, 2012.

*Primary Examiner* — Cathleen Hutchins
*Assistant Examiner* — Taras P Bemko
(74) *Attorney, Agent, or Firm* — Williams Mullen

(57) ABSTRACT

A hydraulic wellbore anchoring system for use with whipstocks or other tools in either cased or open hole wellbores. The anchoring system includes an upper slip system and a lower slip system. The anchor system may be set using hydraulic pressure and withdrawn by a predetermined upward force. While the slips of the upper and lower slip systems may be set substantially simultaneously, the anchoring system enables sequential disengagement of the slips to reduce the force required for withdrawal.

17 Claims, 12 Drawing Sheets

WELLBORE ANCHORING SYSTEM

CROSS-REFERENCE TO RELATED APPLICATIONS

None

STATEMENT REGARDING GOVERNMENT SUPPORT

None

BACKGROUND

1. Field of the Invention

The present system relates to devices used in the drilling of wells, and more particularly, to a wellbore anchoring system for use with wellbore tools such as whipstocks.

2. Description of the Related Art

Wellbore anchoring systems may be used to anchor drilling equipment downhole, or to permit certain wellbore operations. Some anchoring systems may be used, for example, to fix inclined planes or wedges in the bore, such as a whipstock, for deflecting or changing the angle or direction of drilling from that of the original borehole.

Some approaches use an inflatable element within the anchoring system for open holes. The inflatable packer element expands during inflation to grip the formation about the wellbore. Inflatable elements may be limited in gripping ability, particularly if subjected to an axial force. However, if the inflation media permits deflation, then the anchor system may be withdrawn after use.

Approaches using mechanical anchors typically have either dogs that mate with channels installed within the wellbore, or members that may be forced into a lateral position relative to the borehole, such as teeth or slips that bite into the sides of a wellbore when expanded (or 'set.')

In many cases, the anchoring systems rely on mechanical devices for setting the slips into position while in position downhole. Such approaches can be complicated by distance and the considerable forces required, which in some cases reduces the grip or security of the anchor. For example, some anchoring systems require a separate setting tool to apply the setting force to the anchor system via a mandrel. Such a tool might activate a slip cone, for example, so that it moves within the anchor; the increasing cross section of the cone may then force the slips to expand. Apart from added expense and complexity, a setting tool must be able to apply a sufficient setting force to the anchor system while both the anchor and the tool are at the desired location down hole.

Some conventional approaches involve devices that are not capable of removal once set. Other conventional approaches may be removable, but require substantial upward forces to be applied to a set anchoring system. A need exists for an anchor system with improved reliability, simplicity, and lower removal forces over conventionally available anchor devices.

SUMMARY

The present wellbore anchoring system is provided as an elongated body along a central longitudinal axis having an upper end and a lower end. The body defines an average outer surface at a first average outer diameter. An aspect of embodiments may have an upper slip system comprising at least one upper slip, a lower slip system comprising at least one lower slip, a hydraulic setting system in operable engagement with the upper and lower slip systems such that application of a predetermined hydraulic pressure to the system expands the at least one upper and lower slips laterally to a set position at a second average outer diameter that is greater than the first average outer diameter, and a withdrawal system disposed within the body and configured such that application of a predetermined upward force on the elongated body when the at least one upper and lower slips are in the set position operably engages the upper slip system to retract the at least one upper slip and operably engages the lower slip system to retract the at least one lower slip, and wherein the at least one upper slip and at least one lower slip are retracted substantially sequentially.

Some embodiments of the anchoring system may have the at least one upper slip and the at least one lower slip oriented laterally about the longitudinal axis at a relative offset. Optionally, the at least one upper slip comprises three upper slips oriented about the longitudinal axis at about 120-degrees relative to each other, and the at least one lower slip may comprise three lower slips oriented about the longitudinal axis at about 120-degrees relative to each other. Further, the upper slips and lower slips may be oriented about the longitudinal axis at a relative offset of about 60-degrees.

An aspect of another embodiment is that the at least one upper and lower slips might have a T-shaped member, the elongated body defines a T-slot corresponding to each slip T-shaped member, and further wherein the slip T-shaped members are disposed within the T-slot such that the at least one upper and lower slips are slideably engaged with the body.

Optionally, the wellbore anchoring system body may have an upper portion, a lower portion, and a mid portion, with the upper and lower slip systems disposed in the mid portion, the upper portion may include a top subassembly with a top subassembly upper face, a top subassembly lower face. The mid portion may define a mid portion longitudinal length, the mid portion further comprising an upper rod retainer, an upper slip retainer, an upper rod, a lower rod retainer, a lower slip retainer, a lower rod, with the mid portion having an mid portion upper face, a mid portion lower face, the mid portion defining an internal mid channel running longitudinally and open to the mid portion upper and lower faces. The lower portion comprises a piston assembly and a bottom subassembly, the piston assembly having a piston assembly upper face, a lower face, and an inner face defining a passage. A mandrel may be provided, having a mandrel upper end and a mandrel lower end, a mandrel longitudinal length greater than the mid portion longitudinal length, the internal mid channel configured to receive the mandrel, the mandrel defining a mandrel upset. The top assembly lower face may define an upper receptacle for receiving a portion of the mandrel upper end, the mandrel passing through the passage of the piston assembly. The piston assembly may be slideably mounted about the mandrel at the piston assembly inner face. The lower portion may define a lower receptacle for receiving a portion of the mandrel lower end. In this version, the elongated body may be configured such that an application of a predetermined upward force to the body, when the at least one slips are in the set position, shoulders the upper rod retainer against the mandrel upset, engaging the at least one upper slip with an upward and retracting force through the upper slip retainer, the upper slip retainer shoulders against the upper rod engaging the at least one lower slip with an upward and retracting force through the lower slip retainer, so as to retract the at least one upper slip and at least one lower slip are retracted substantially sequentially.

Optionally, the wellbore anchoring system body may have an upper portion, a lower portion, and a mid portion. The upper portion may include a top subassembly with a top subassembly upper face, a top subassembly lower face, and the upper portion defines an internal upper channel running longitudinally and open to the top subassembly upper and lower faces. The mid portion may have a mid portion longitudinal length, the mid portion comprising an upper rod retainer, an upper rod, lower rod retainer, a lower rod, the mid portion having an mid portion upper face, a mid portion lower face, and defining an internal mid channel running longitudinally and open to the mid portion upper and lower face. The lower portion may include a piston assembly, a sleeve, and a bottom subassembly, the piston assembly disposed within and in longitudinal slidable relation to the sleeve, having a piston assembly upper face, a lower face, and an inner face defining a passage into an inner chamber defined by the lower portion, the lower portion further defining an internal lower channel running longitudinally. A mandrel may be provided having a mandrel upper end and a mandrel lower end, a mandrel longitudinal length greater than the mid portion longitudinal length. The internal mid channel may be configured to receive the mandrel. The mandrel may define an internal mandrel channel running longitudinally and open to the mandrel upper and lower faces. The top assembly lower face may define an upper receptacle for receiving a portion of the mandrel upper end with the internal top upper channel in fluid communication with the internal mandrel channel. The mandrel may pass through the passage of the piston assembly with the piston assembly slideably mounted about the mandrel at the piston assembly inner face. The lower portion may define a lower receptacle for receiving a portion of the mandrel lower end with the internal lower channel in fluid communication with the internal mandrel channel. The internal mandrel channel may be in fluid communication with the inner chamber of the piston assembly. In this version, the elongated body may be configured such that application of a hydraulic fluid at a predetermined pressure within the internal top upper channel, the internal mandrel channel, the internal lower channel, and the inner chamber, causes the piston assembly to move upwardly along the longitudinal axis relative to the bottom subassembly, so as to operably engage the mid portion such that the lower rod retainer moves upwardly reduces the mid portion longitudinal length and causes the upper rod retainer and lower rod to operably engage the upper slip system so as to expand the at least one upper slip laterally to a set position at a second outer diameter, and the upper rod to operably engage the lower slip system so as to expand the at least one lower slip laterally to a set position at the second outer diameter substantially simultaneously.

Optionally, the lower portion may include a ratchet ring operably engaged with the piston assembly and configured such that when the at least one upper slip and at least one lower slip are in the set position, the ratchet ring locks the elongated body in position. In another option, the lower subassembly may have or define a remotely activated port in fluid communication with the internal lower channel.

Optionally, the elongated body mid portion may include an upper slip body engaged with a lower rod, a lower slip body engaged with a lower rid retainer, wherein the at least one upper and lower slips further have a T-shaped member; and further wherein the upper slip retainer, the upper body, the lower slip retainer, and the lower slip body define a T-shaped slot corresponding to each slip T-shaped member with the T-shaped members of the at least one upper and lower slips disposed within the T-shaped slot such that the at least one upper and lower slips are slideably engaged with the body.

One embodiment of the wellbore anchoring system may have a body elongated along a central longitudinal axis with an upper end and a lower end. The body may be considered as having an upper portion, a lower portion, and a mid portion. The body defines an average outer surface at a first average outer diameter. The upper portion may include a top subassembly with a top subassembly upper face, a top subassembly lower face, and the upper portion may define an internal upper channel running longitudinally and open to the top subassembly upper and lower faces. The mid portion may define a mid portion longitudinal length, the mid portion having an upper rod retainer, an upper slip retainer, an upper rod, at least one upper slip, at least one lower slip, a lower slip retainer, a lower rod retainer, a lower rod. The mid portion may have a mid portion upper face, a mid portion lower face, and may define an internal mid channel running longitudinally and open to the mid portion upper and lower face. The lower portion may include a piston assembly, a sleeve, and a bottom subassembly, with the piston assembly disposed within and in longitudinal slidable relation to the sleeve. The piston assembly may have a piston assembly upper face, a lower face, and an inner face defining a passage into an inner chamber defined by the lower portion. The lower portion may further define an internal lower channel running longitudinally. A mandrel may be provided with a mandrel upper end and a mandrel lower end, a mandrel longitudinal length greater than the mid portion longitudinal length. The internal mid channel may be configured to receive the mandrel. The mandrel may define an internal mandrel channel running longitudinally and open to the mandrel upper and lower faces. Further, the mandrel may feature a mandrel upset. The top assembly may have a lower face defining an upper receptacle for receiving a portion of the mandrel upper end with the internal top upper channel in fluid communication with the internal mandrel channel. The mandrel may pass through the passage of the piston assembly with the piston assembly slideably mounted about the mandrel at the piston assembly inner face. The lower portion may define a lower receptacle for receiving a portion of the mandrel lower end with the internal lower channel in fluid communication with the internal mandrel channel. The internal mandrel channel may be in fluid communication with the inner chamber of the piston assembly.

In this version, the elongated body may be configured such that application of a hydraulic fluid at a predetermined pressure within the internal top upper channel, the internal mandrel channel, the internal lower channel, and the inner chamber, operably causes the piston assembly to move upwardly along the longitudinal axis relative to the bottom subassembly, so as to operably engage the mid portion such that the lower rod retainer moves upwardly reducing the mid portion longitudinal length and causing the upper rod retainer and lower rod to operably engage the upper slip system so as to expand the at least one upper slip laterally to a set position at a second outer diameter, and the upper rod to operably engage the lower slip system so as to expand the at least one lower slip laterally to a set position at the second outer diameter substantially simultaneously, wherein the second average outer diameter that is greater than the first average outer diameter. The body may also be configured such that an application of a predetermined upward force to the body, when the at least one slips are in the set position, shoulders the upper rod retainer against the mandrel upset, engaging the at least one upper slip with an upward and retracting force through the upper slip retainer, the upper slip retainer shoulders against the upper rod engaging the at least one lower slip with an upward and retracting force through the lower slip retainer, so as to retract the at least one upper slip and at least one lower slip are retracted substantially sequentially. In this embodiment, all of the foregoing options or aspects may also be provided.

DETAILED DESCRIPTION

The present system is a hydraulic wellbore anchoring system for use with whipstocks or other tools in either cased or open-hole wellbores. That is, the device disclosed in various embodiments may find application when a wellbore anchoring system is needed, including for example, when needed for anchoring wellbore tools such as whipstocks.

The anchoring system may be implemented in a body elongated along a longitudinal axis for placement within or running into a target wellbore. In general, the anchoring system a body elongated along a central longitudinal axis, defining an average outer surface at a first average outer diameter, an upper slip system comprising at least one upper slip, a lower slip system comprising at least one lower slip, a setting system disposed within the body in operable engagement with the upper and lower slip systems to expand the at least one upper and lower slips to a set position at a second average outer diameter that is greater than the first average outer diameter; and a withdrawal system disposed within the body and configured such that application of a predetermined upward force on the elongated body when set operably engages the upper slip system to retract the at least one upper slip and operably engages the lower slip system through the upper rod to retract the at least one lower slip, and wherein the at least one upper slip and at least one lower slip are retracted sequentially. The setting system is simply the structure permitting the setting of the anchoring system, as provided herein. The withdrawal system is simply the structure permitting retracting of the slips for withdrawal of the anchoring system, as provided herein.

For convenience of reference without limitation, the elongated body may generally be considered as an upper portion, a mid portion, and a lower portion for purposes of reference in relative disposition along a longitudinal axis. The body includes two slip systems, one upper and one lower. A slip system may be set or operated to expand at least one slip each by application of a predetermined or requisite hydraulic pressure along an internal channel. The slip systems may be configured so as to set the body in the center of the wellbore without cocking, as described below. The body may be withdrawn from the wellbore by an upward force less than that required for conventional approaches. An aspect of embodiments of the present system is that application of a predetermined upward force withdraws anchoring slips substantially sequentially, in order to reduce the force required to remove the body or system from a wellbore. However, as shown herein, this may be achieved without sequential extension or setting of slips. "Substantially" sequentially means sufficiently sequential for the desired reduction in removal force.

The figures show an exemplary embodiment of a wellbore anchoring system. Alternative approaches or embodiments may be undertaken, with the embodiments disclosed being examples.

Figure 1:
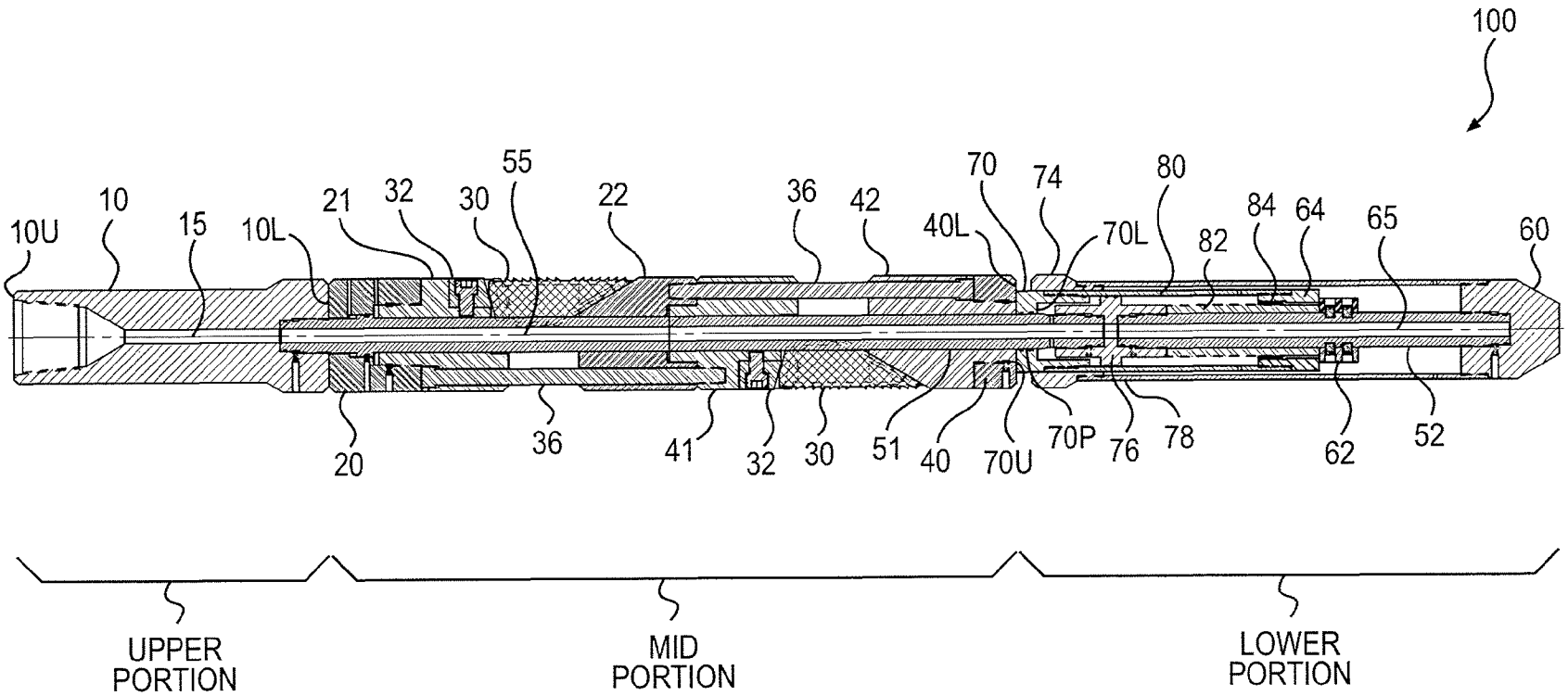
FIG. 1 is side view cutaway of an embodiment of the anchor system elongated body detailing its components.
Figure 6B:
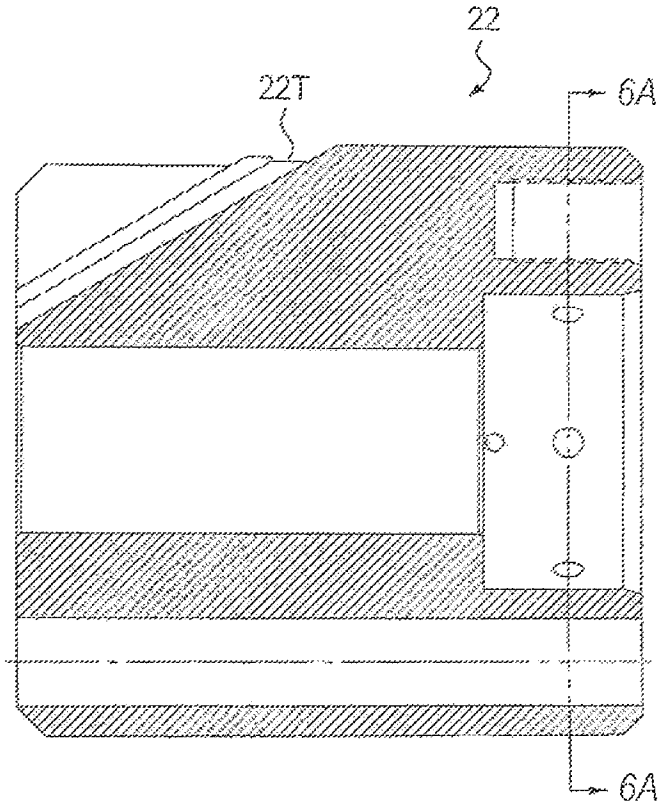
FIGS. 6A-6B show various views of an upper slip body.
Figure 6A:
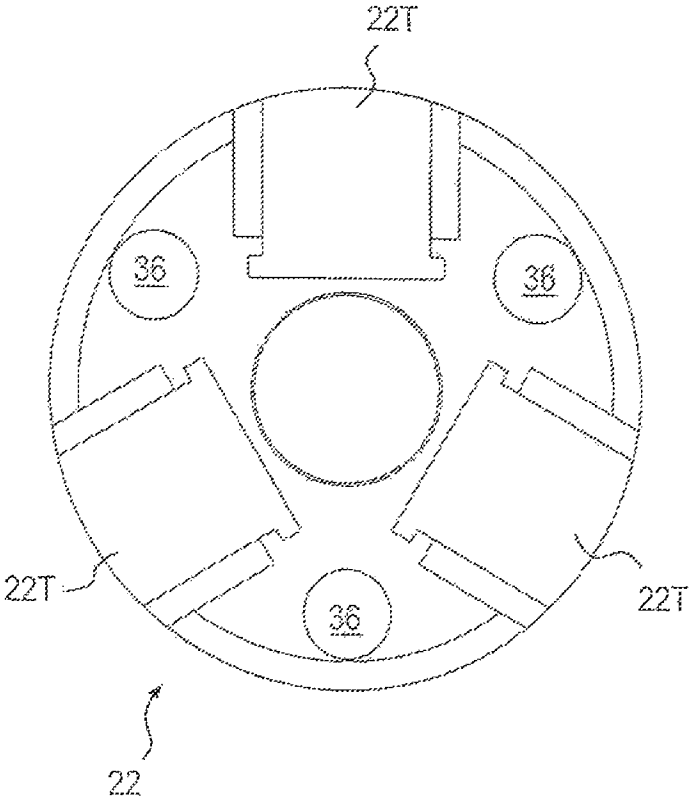
Figure 7B:
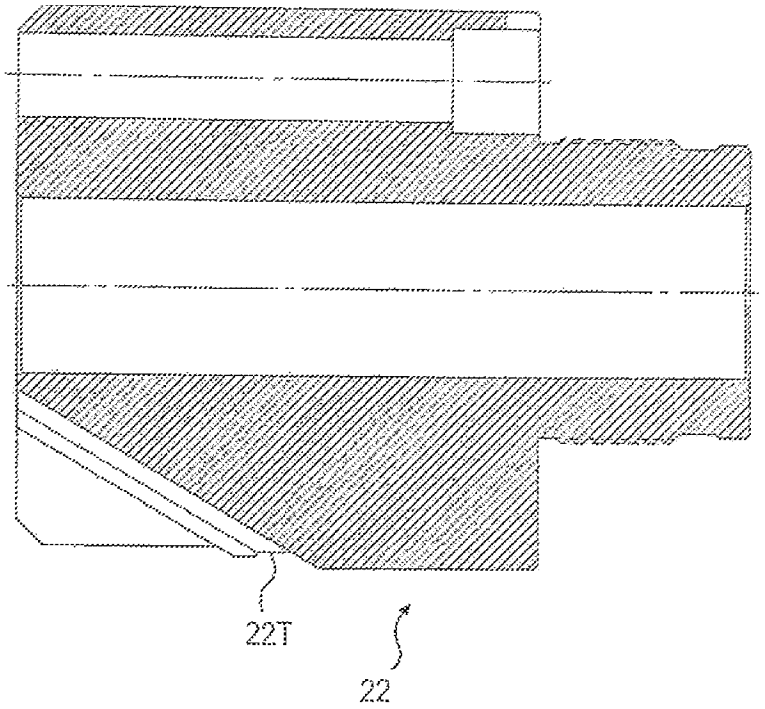
FIGS. 7A-7B show various views of a lower slip body.
Figure 7A:
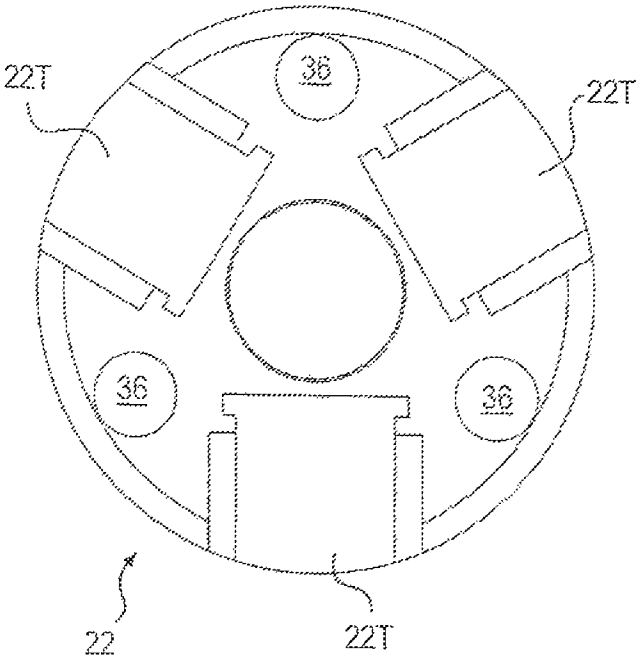

FIG. 1 is a side cross sectional view of an embodiment of the anchoring system in the form of an 8-inch outer diameter anchor with dual slip sets, with a central or longitudinal axis moving from left to right. FIGS. 2A-E provide detailed views of the embodiment in FIG. 1. FIGS. 3-4 illustrate operation of embodiments of the anchoring system with slips extended to different second average outer diameters. FIGS. 5-7 provide additional detail of the exemplary embodiment in FIG. 1. The present approach may be used or may enable drilling in an inclined or non-vertical plane (when within a wellbore) by use with a wedge or whipstock; however the left end may generally be considered an upper (or aft) relative portion, while the right end may be considered the lower (or forward) portion. The term 'average" in modification of diameter is intended to convey a general radial or lateral extent for the referenced element, without requiring absolute uniformity. As may be seen in FIG. 3A, for a body at a running in configuration a first average outer diameter does not convey a uniform lateral projection along the longitudinal axis, but generally a projection consistently less than a subject wellbore inner diameter (i.e., for this configuration).

In FIG. 1 may be seen various components of anchoring system or elongated body 100 moving left to right or from upper portion to lower portion. For example, a top subassembly 10 may be proximate to an upper rod retainer 20 and an upper slip retainer 21. The top subassembly 10 lower face 10L proximate to upper rod retainer 20 may be considered as a transition point from an upper portion of the body to a mid portion. For this embodiment, within the mid portion there are two slip systems (A slip system is simply the structure of elongated body 100 supporting the mounting and operation of slips 30, including the at least one slip 30), an upper and lower system, each with at least one slip and shown with three slips 30. The slips 30 may set together or substantially at the same time for enabling the centering of anchoring system body 100. Operation of the slips 30 in this embodiment is discussed in greater detail below. As shown, for each at least one slip 30, the upper and lower slip systems may have a corresponding upper and lower slip retainer 21, 41, and upper and lower slip bodies 22, 42. Upper and lower rods 36, with upper and lower rod retainers 20, 40, inter-relate operably within the slip systems as described herein. Upper slip body 22 and lower slip body 42 may be used within the upper and lower slip systems for operably engaging with their respective at least one slip 30. Lower rod retainer 40 lower face 40L may be considered as a transition point from the mid portion of the body 100 to a lower portion of the body 100. The nomenclature of upper, mid, and lower is provided for convenience of reference in relative disposition of the elements.

In this example, an upper mandrel 51 may run longitudinally along the central or longitudinal axis. As shown, upper mandrel 51 may extend beyond the longitudinal length of the mid portion, and may be embodied in segments as an upper mandrel 51 and lower mandrel 52 connected by connector 76, or as a single segment (not shown) depending on the application.

Figure 8A:
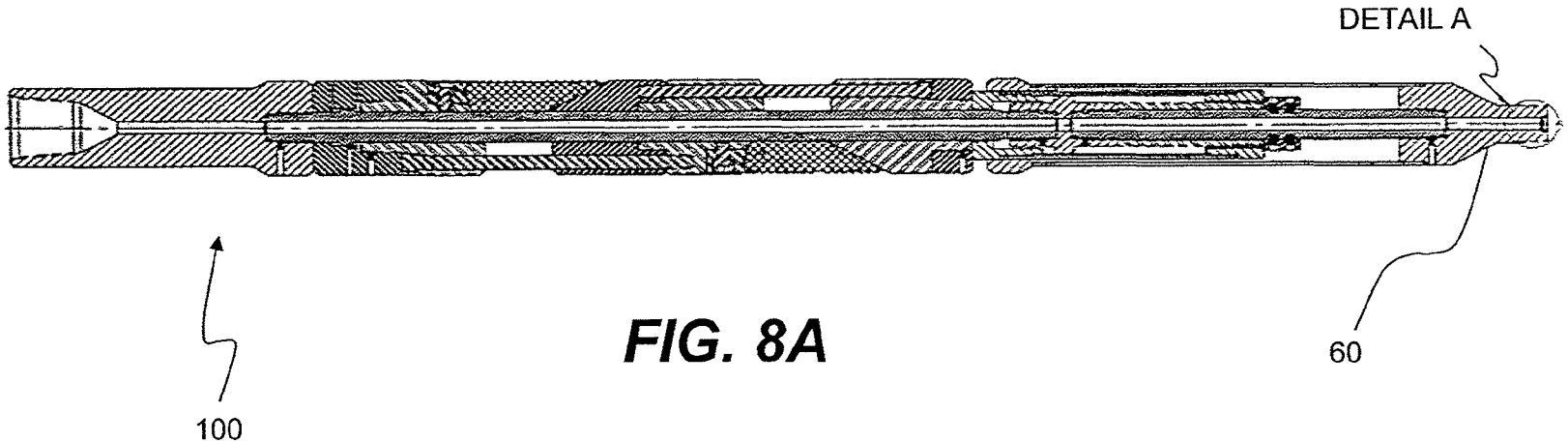
FIGS. 8A-8B illustrate a detail of an optional embodiment.
Figure 8B:
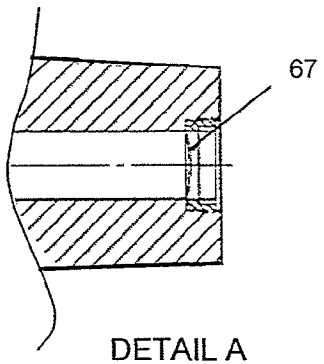

For the embodiment shown, upper mandrel 51 may define an inner mandrel channel 55. This inner mandrel channel 55 may connect with or be in fluid communication with like internal upper channel 15 in the upper portion and lower internal channel 65 in lower portion of the elongated body 100, as shown. Of course, a variety of channel structures may be designed as appropriate, being a function of the application, the configuration of the slip systems, and the actuation or mode of operating the slip systems. In some embodiments, bottom subassembly 60 may include an additional remotely activated port, valve, or channel, such as rupture disc 67, (see FIG. 8B) permitting the passing of fluids through the body 100 along the channel system after the body 100 is set within a wellbore.

In this embodiment, upper face 70U of piston 70 (i.e., shown opposing lower face 70L of piston 70) faces or contacts the lower face 40L of lower rod retainer 40. Mandrel 51 may pass through a passage 70P (shown filled with mandrel 51) defined by an inner face of the piston 70 with the piston 70 slideably mounted about the mandrel 51 (i.e., inner face 70P of piston 70 facing mandrel 51; additional detail shown in FIG. 2D.) Piston 70, housing 80, bottom nut 64, and ratchet ring 84 may move together relative to sleeve ring 74, casing sleeve 78, bottom subassembly 60, as well as mandrel 51, 52 and connector 76. Lower mandrel 52 may be received by bottom subassembly 60. As noted, other applications or embodiments may produce different structural interrelations of specific components, while achieving the same objects.

Figure 2B:
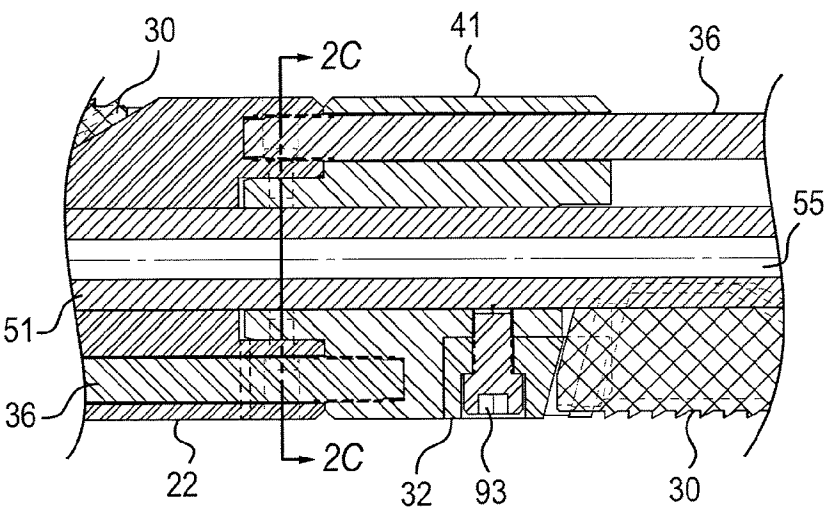
FIGS. 2A-2E are various details of the embodiment in FIG. 1.
Figure 2A:
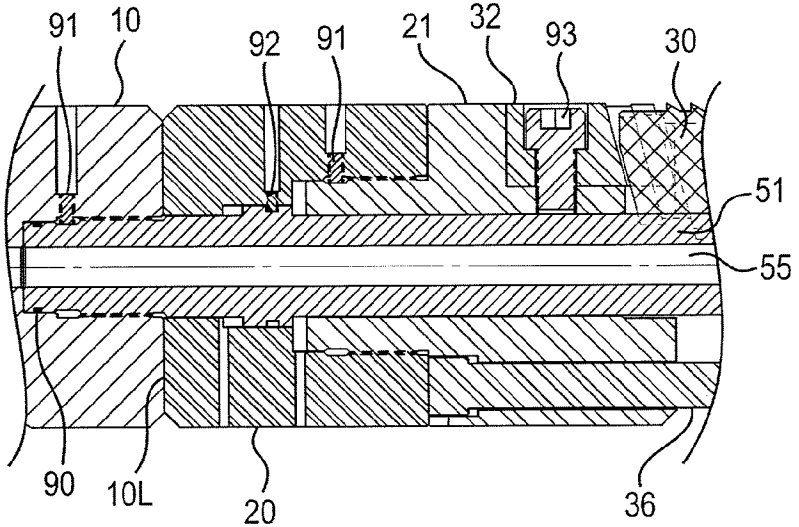
Figure 2C:
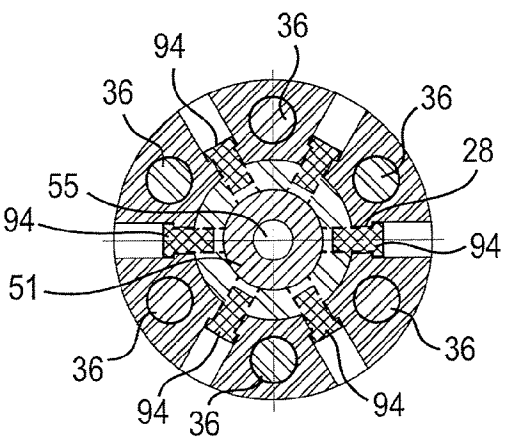

FIG. 2A is a detail of the interface between top subassembly 10 and upper rod retainer 20, with fasteners 91, 93 and shear members 92. FIG. 2B is a detail of a segment of the mid portion, showing upper and lower rods 36, upper slip body 22, lower slip retainer 41, slip retainer insert 32, at least one upper and lower slips 30, mandrel 51, internal mandrel channel 55, and fastener 93. FIG. 2C is a detail showing a cross section view of the section in FIG. 2B, illustrating shear members 94, cross sections of rods 36, and inner mandrel channel 55 of mandrel 51.

Figure 2D:
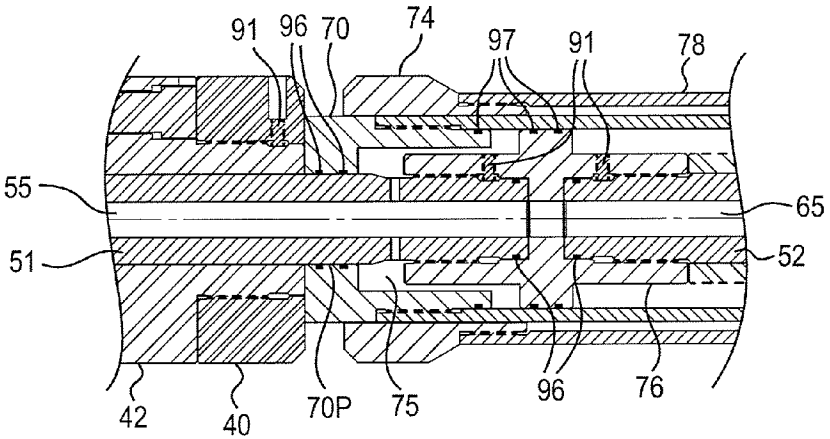

FIG. 2D is a detail of the interface between lower rod retainer 40, lower slip body 42, and piston 70. An inner face at 70P of piston 70 defines a passage into an inner chamber 75 defined by the lower portion, with the mandrel 51 running through the passage of piston 70 along 70P and inner chamber 75, with inner mandrel inner channel 55 in fluid communication with inner chamber 75. As shown, piston 70 may be slideably mounted about the mandrel 51 at the inner face 70P, optionally with o-rings 96. The lower portion, namely for this embodiment connector 76, defines a receptacle for receiving a portion of mandrel 51. For this two segmented embodiment with mandrels 51 and 52 jointed by connector 76, lower portion bottom subassembly 60 may also be adapted to define a receptacle for receiving a portion of mandrel 52 (shown in FIG. 2E). FIG. 2D also shows fasteners 91 and optional o-rings 96 and 97.

Figure 2E:
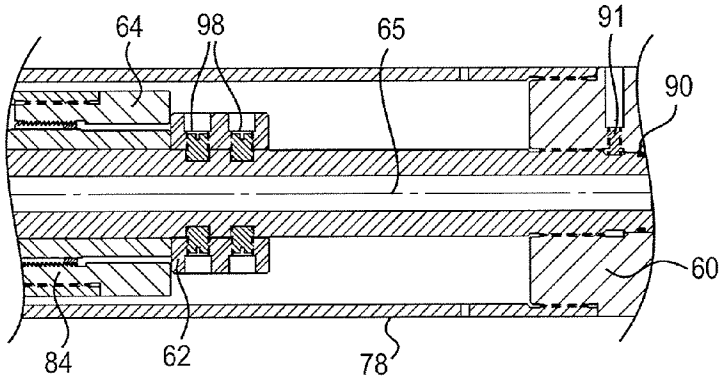

FIG. 2E is a detail of an aspect lower down than that depicted in FIG. 2D. Shown are casing sleeve 78, bottom nut 62, and bottom subassembly 60. Lower internal mandrel channel 65 continues as a portion of lower mandrel 52 from mandrel 51. Ratchet ring 84, the operation of which is discussed below, is shown along with shear sleeve 62 and fasteners 91 and 98. Also shown is optional o-ring 90.

Figure 3A:
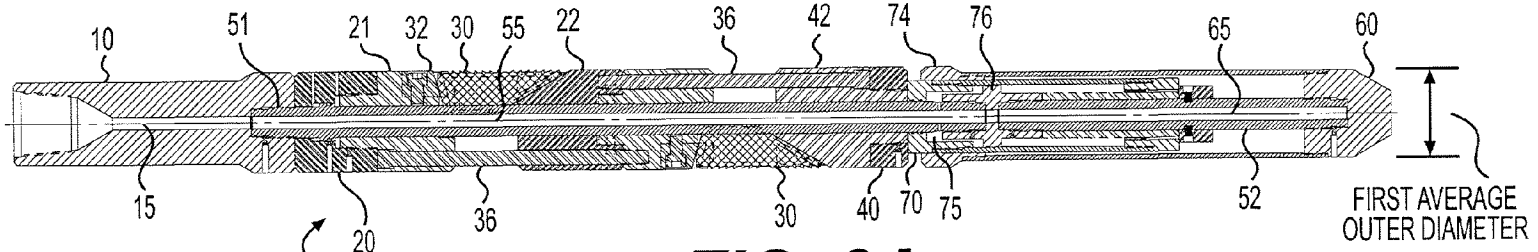
FIGS. 3A-3F illustrate operation of an embodiment of the anchor system.
Figure 3B:
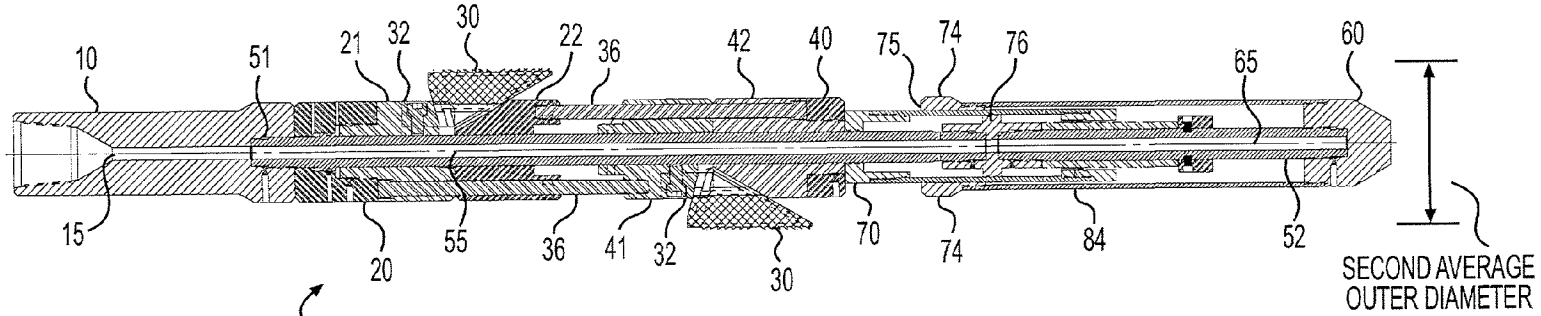

The operation of anchoring system body 100 may be described as lowering or running in, setting, and withdrawal. This operation may be seen in FIG. 3 for an embodiment with relatively larger expansion of slip 30, and FIG. 4 for an embodiment with a relatively smaller expansion of slip 30. FIGS. 3A and 4A show an elongated body 100 in a running in configuration, suitable for lowering into a wellbore to a desired position or depth with the elongated body 100 defining a first average outer diameter. FIGS. 3B and 4B show elongated body 100 with application of a hydraulic fluid at a predetermined pressure for setting. The structure implementing setting of elongated body 100 may for convenience be referred to or considered as a hydraulic setting system. Hydraulic fluid under pressure may be applied to the internal upper channel 15, which opens to the upper face 10U (FIG. 1) of top subassembly 10. Internal upper channel 15 is in fluid communication with internal mandrel channel 55, which is in communication with internal lower channel 65 and inner chamber 75 (see FIG. 2D) below piston 70. When the hydraulic fluid reaches a predetermined pressure, piston 70 moves relatively upwards along mandrel 51 (piston 70 and its associated fixed or attached elements may also be referred to as a piston assembly.) Piston upper face 70U (FIG. 1) abuts lower rod retainer 40 lower face 40L (FIG. 1), driving lower rod retainer 40, lower slip body 42, the lower of rods 36, and upper slip body 22 upward. This extends and sets slips 30 to a second average outer diameter that is greater than the first average outer diameter. The at least one lower slip 30 (driven against lower slip retainer 41) expands as lower slip body 42 moves up; the at least one upper slip 30 (driven against upper slip retainer 21) expands as upper slip body 22 moves up. Optionally, shear member 94, such as a shear screw, may shear at a desired setting point (see FIG. 2C). Note that the extension or setting of the at least one upper and lower slips 30 may be implemented substantially simultaneously, as may be desired.

A ratchet ring 84 (see detail in FIG. 2E) may lock in a setting force. No other force would then be required for setting. The hydraulic system fluid pressure may be withdrawn or reduced. The role of shear members 94 in these steps is to keep anchoring system body 100 components in a desirable run-in position until reaching the predetermined pressure of hydraulic fluid required for shearing and setting, and overcomes a potential problem of premature setting. At the same time, setting involves an advantageous simultaneous extension of the at least one upper and lower slips 30.

An aspect of some embodiments of the anchoring system is that the hydraulic system inner channels may then be used for the passage of fluids other than the hydraulic fluids used during setting. In other words, hydraulic pressure is used in setting the anchoring system body 100, but it is not required afterwards so long as a setting force remains, such as with ratchet ring 84 or other locking device. The flow paths may then serve for the passage of fluids through elongated body 100. For example, in an embodiment shown in FIGS. 8A and 8B, lower subassembly 60 may include a remotely activated port, such as rupture disc 67 shown in Detail A, or other similar such channel, valve, or port that may be configured to be opened by remote action. After elongated body 100 may be set within a wellbore, a predetermined activating hydraulic pressure higher than the setting pressure may be applied remotely to body 100. Rupture disc 67 may be configured to rupture at this activating pressure, permitting fluid communication out of the various internal channels of elongated body 100 and into some other desired fluid carrying structure, such as a connecting pipe (not shown) mating with lower subassembly 60.

Figure 3C:
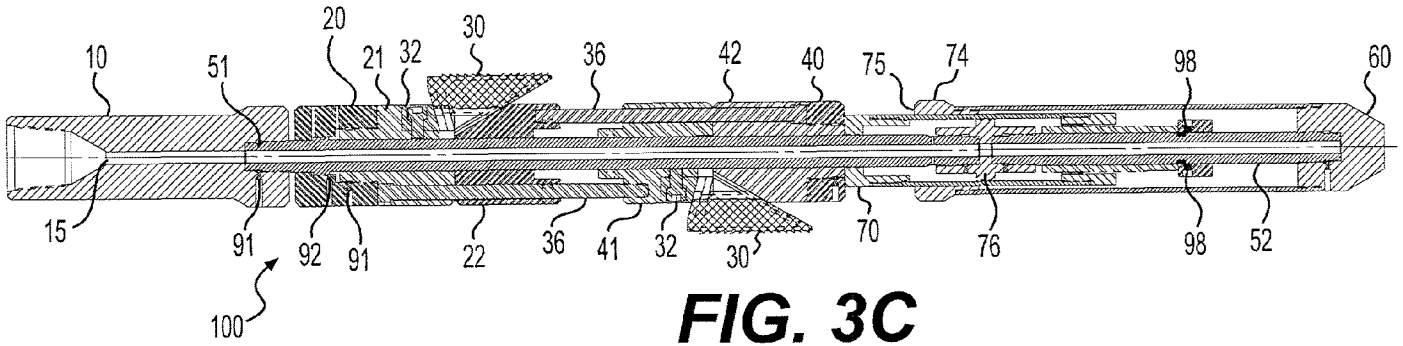
Figure 3D:
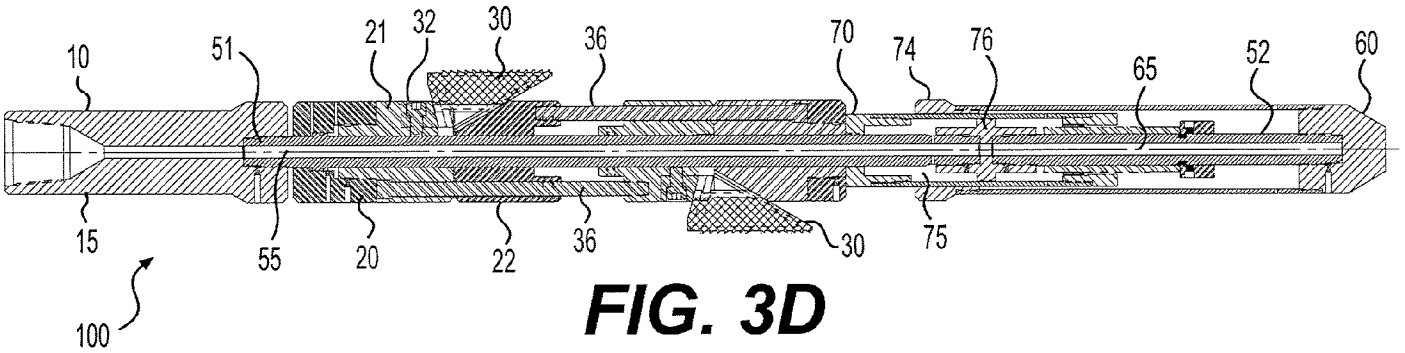
Figure 3E:
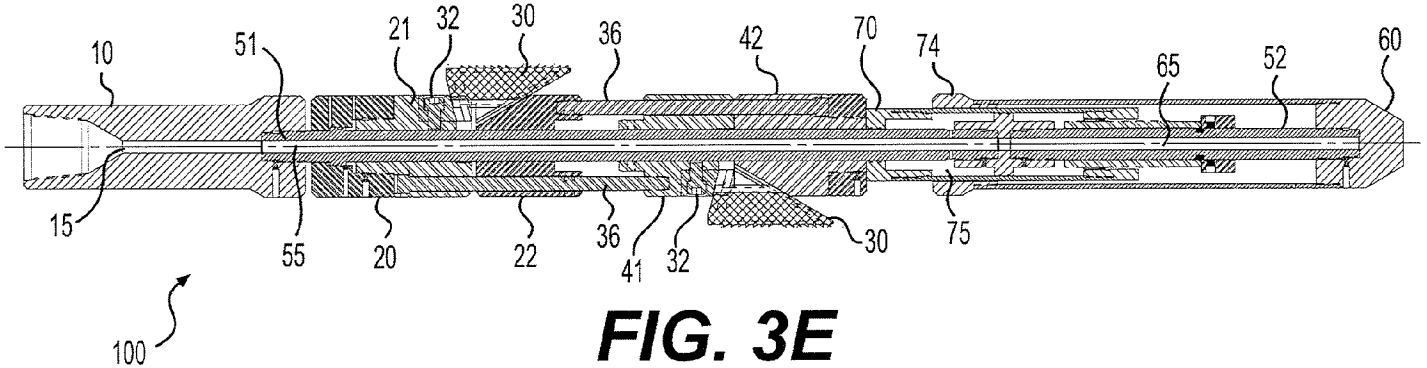
Figure 3F:
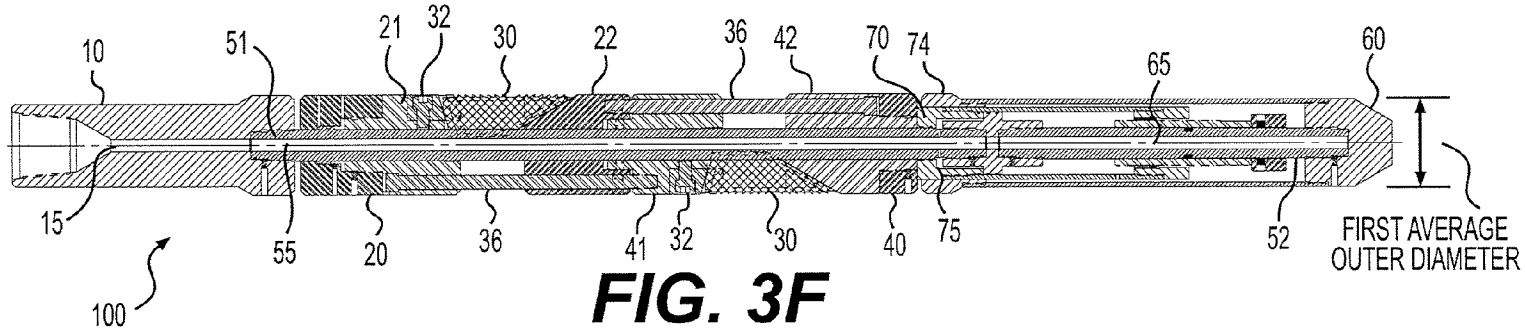
Figure 4A:
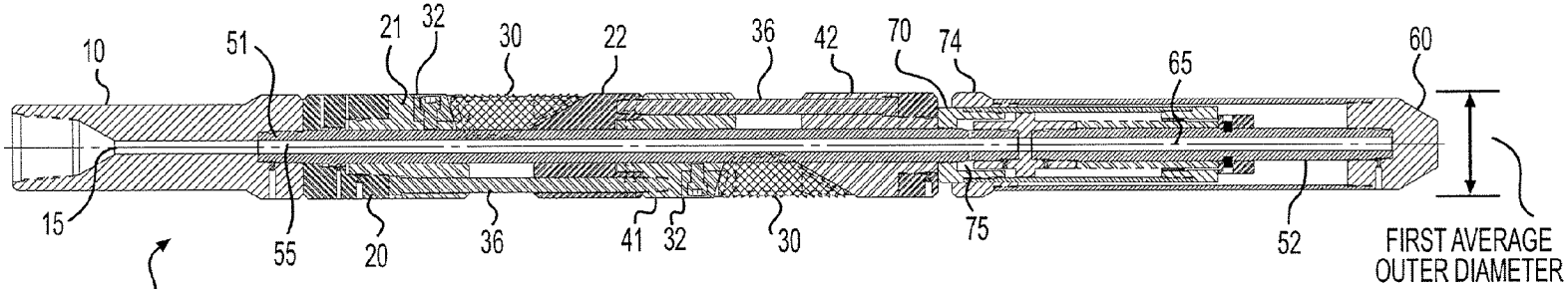
FIGS. 4A-4F illustrate operation of an embodiment of the anchor system.
Figure 4B:
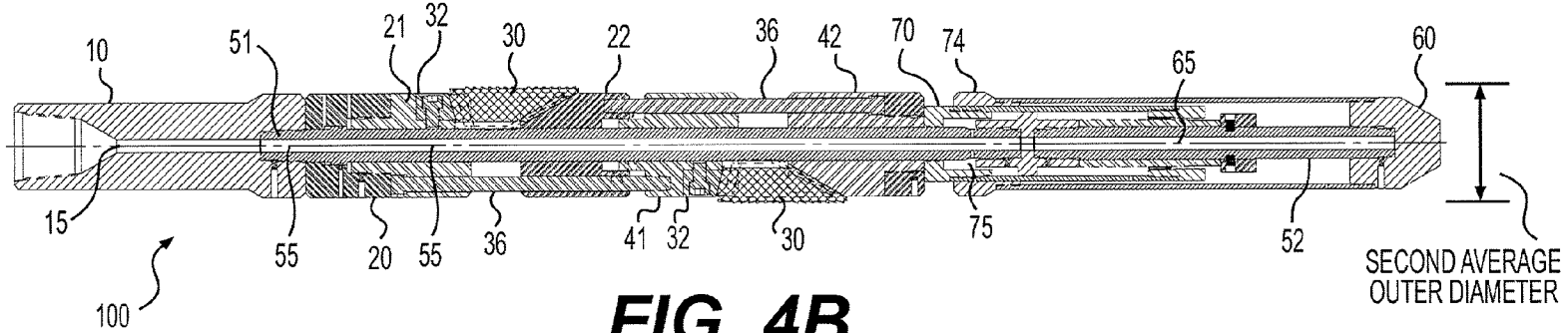
Figure 4C:
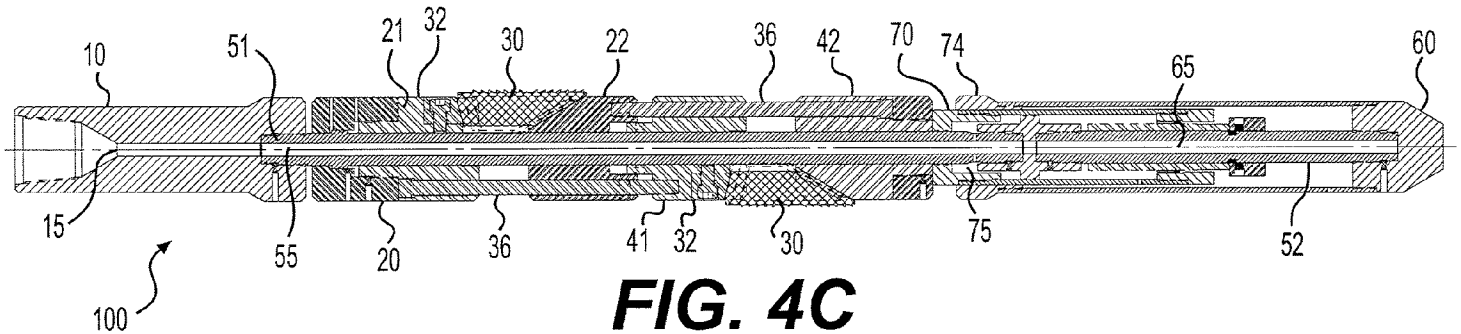
Figure 4D:
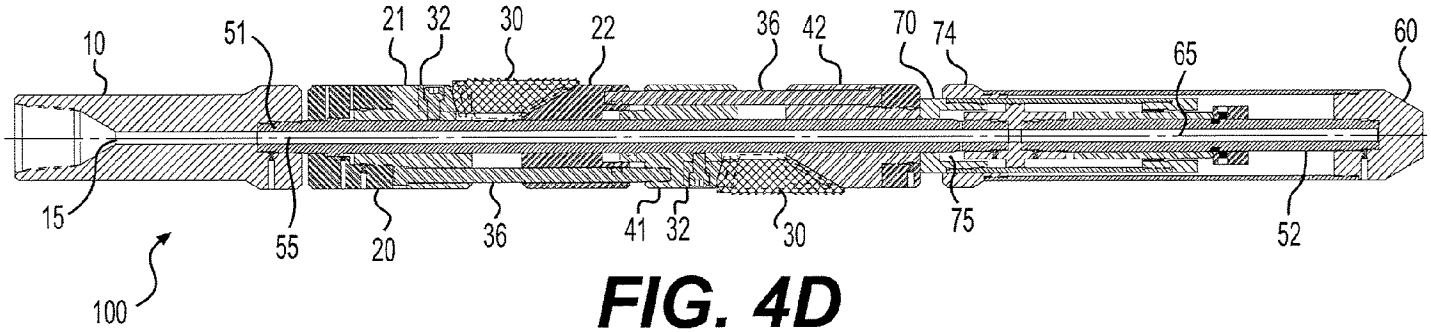
Figure 4E:
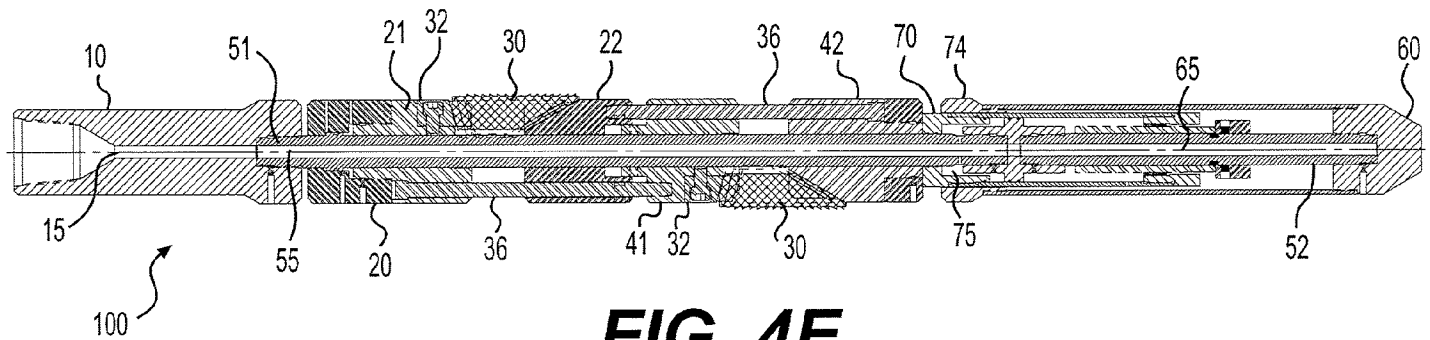
Figure 4F:
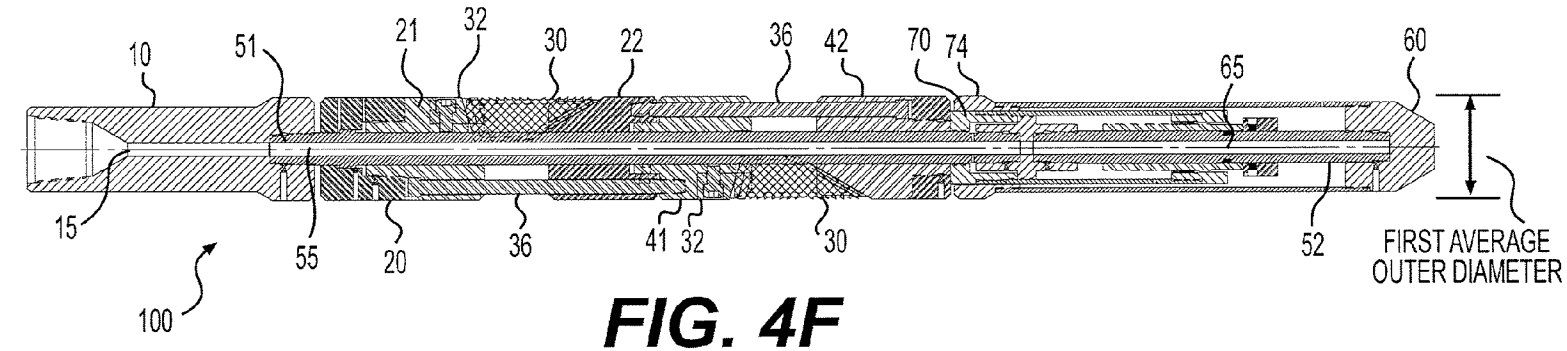

FIGS. 3C-F and FIGS. 4C-F show the sequence of steps for picking up or withdrawing a set anchoring system or elongated body 100 from a wellbore. The structure implementing withdrawal of elongated body 100 may for convenience be referred to or considered as a withdrawal system disposed within the body. A predetermined upward force may be used to release the set and to remove elongated body 100. As shown in FIGS. 3C and 4C, the upward force shoulders upper rod retainer 20 against a feature, such as an upset or other structural characteristic of mandrel 51, shearing shear member 92 (see FIG. 2A) and shear member 98 (see FIG. 2E.) FIGS. 3D and 4D show how upper slip retainer insert 32 may be shouldered against an upper end of the at least one upper slips 30, beginning to pull the at least one upper slips 30 upward. FIGS. 3E and 4E show how upper rod 36 may be shouldered against upper slip retainer 21 (via upper slip body 22), such that the lower slip retainer 41 may be shouldered against or pulling on at least one lower slip 30. FIGS. 3F and 4F show the retraction of at least one upper and lower slips 30, with the body 100 returning to the first outer diameter running in configuration, as ultimately piston 70 is shouldered against lower rod retainer 40. At this point, body 100 may be removed or picked up from the wellbore.

An advantageous aspect of this approach is the substantially sequential manner of withdrawing at least one upper and lower slips 30, which decreases the upward force required to unset the anchoring system body 100. This configuration is also embodied in a form that does not require the sequential (i.e., non-simultaneous) manner of setting slips.

A variety of materials and configurations may be employed. For example, in certain embodiments, a predetermined hydraulic pressure may be on the order of 1000-1500 psi, such as 1345 psi. A withdrawal force may be on the order of 100,000-120,000 lbs. In such configurations, elongated body 100 may be fabricated from a steel or other metal with about 110,000 psi yield strength.

Figure 5B:
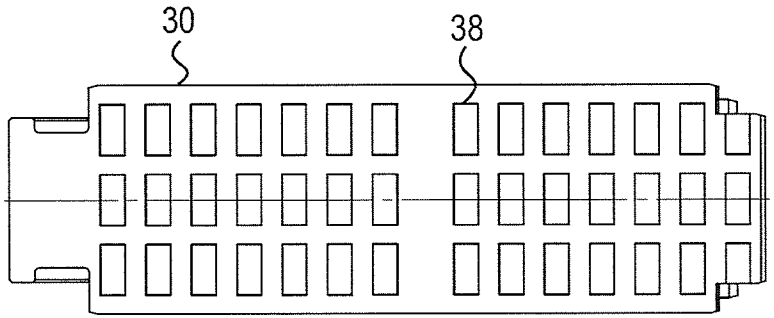
FIGS. 5A-5E show various views of a slip.
Figure 5A:
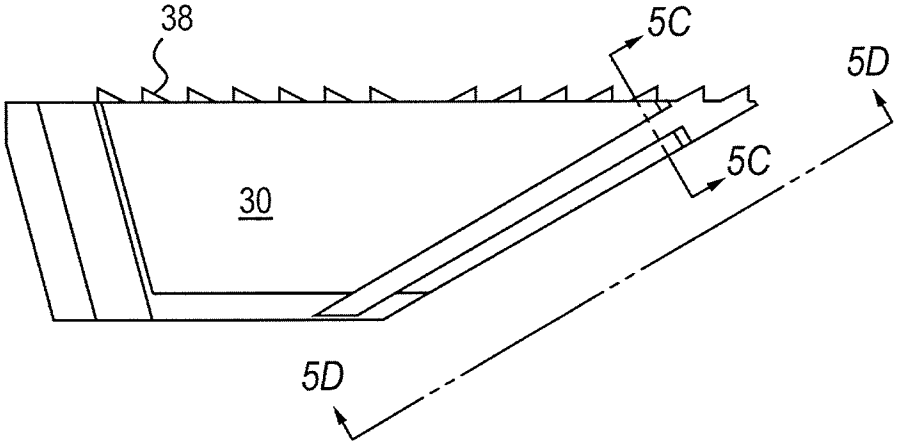
Figure 5C:
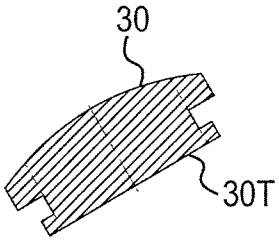
Figure 5E:
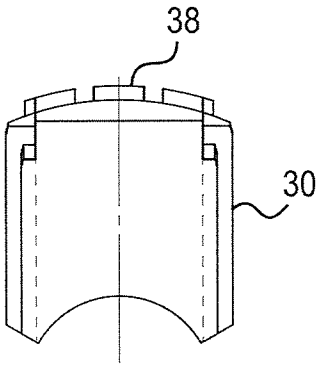
Figure 5D:
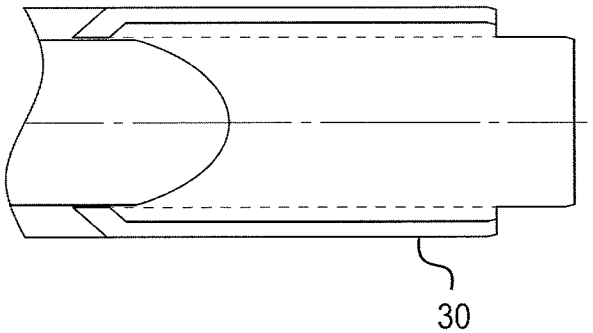

FIGS. 5A-5E provide additional detail about slips 30. FIG. 5A is a side view of a slip 30, with different angles provided. In some embodiments, elongated body 100 may include or define optional T-shaped tracks or slots (or T-slots) 22T (not shown; see FIGS. 6 and 7) by which the slips 30 may be retained. Such an approach enables a slideable or gliding movement of the slips 30 during setting and withdrawal or retrieval. In this embodiment shown in FIG. 5C, for example, the slips 30 may define a T-shaped member 30T that mates with and rides within the T-slots 22T. Additionally, slip 30 shown in FIG. 5A, teeth 38 are shown in bidirectional configuration, supporting anchoring against upward and downward loads when set.

FIGS. 6A-B and 7A-B show an embodiment of upper and lower slip bodies 22, 42, respectively, by which at least one upper and lower slips 30 engage with elongated body 100 (along with upper and lower slip retainers 21, 41, and slip retainer inserts 32). T-slots 22T are shown in these views.

In one embodiment, the present anchoring system body 100 may comprise slips 30 spaced at regular intervals circumferentially in order to center the body 100 within the wellbore when set, helping to avoid cocking of the body 100 during setting. For example, an embodiment in which a slip system's at least one slip 30 comprises three slips 30 might distribute the slips 30 in lateral projection about the longitudinal axis at about 120-degrees relative to each other. Such distribution of the slips 30 aids in centering the body 100 within the wellbore, while equalizing forces. Further, the upper and lower slip systems may be relatively offset from one another about the longitudinal axis; in other words, an 'offset' might be considered as at a different angle in lateral projection from the longitudinal axis. In one example the anchoring system body 100 includes an upper and lower set of slips 30 in which the slips 30 of each set might be equally spaced circumferentially, but with the upper and lower sets of slips 30 having a relative offset of about 60-degrees (see, e.g., FIG. 2C accommodating six rods 36 in this midsection view.) It has been learned that offsetting of the slips 30 in embodiments having upper and lower slip sets contributes to secure and centered anchoring. Further, spacing and offsetting slips 30 may enable advantageous and compact placement of rods 36 or other structure between the slips 30.

In one embodiment, slips 30 may be configured with inclined upper and lower edges (see, e.g., FIG. 5A), assisting the anchoring system body 100 to bear force in both an upward and downward directions. Another aspect is that at least one slips 30 as shown may be suitable for setting with casing or open hole wellbore. One edge of a slip 30 may be angled more steeply than the other (as shown in FIG. 5A). For example, in some embodiments, a slip 30 may have an upper edge angled at about 75-degrees, with a lower edge angled at about 30-degrees, acutely relative to the longitudinal. Such a configuration is suitable for advantageous setting and withdrawal in a variety of formations or casings.

In summary, disclosed is a hydraulic wellbore anchoring system for use with whipstocks or other tools in either cased or open hole wellbores. The anchoring system body includes an upper slip system and a lower slip system. The anchor system may be set using hydraulic pressure and withdrawn by a predetermined upward force. While the at least one slip of the upper and lower slip systems may be set substantially simultaneously, the anchoring system enables sequential disengagement of the slips to reduce the force required for withdrawal.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention.

What is claimed is:

1. A wellbore anchoring system comprising:

a body elongated along a central longitudinal axis having an upper end and a lower end, the body defining an average outer surface at a first average outer diameter, the body further comprising:

(i) an upper portion, a lower portion, and a mid portion, an upper slip system comprising at least one upper slip, a lower slip system comprising at least one lower slip, the upper and lower slip systems disposed in the mid portion;

(ii) the upper portion comprises a top subassembly with a to subassembly upper face, a top subassembly lower face; the mid portion defines a mid portion longitudinal length, the mid portion further comprising an upper rod retainer, an upper slip retainer an upper rod, a lower slip retainer, with the mid portion having a mid portion upper face, a mid portion lower face, the mid portion defining an internal mid channel running longitudinally and open to the mid portion upper and lower faces; the lower portion comprises a piston assembly and a bottom subassembly, the piston assembly having a piston assembly upper face, a lower face, and an inner face defining a passage;

(iii) a mandrel having a mandrel upper end and a mandrel lower end, a mandrel longitudinal length greater than the mid portion longitudinal length, the internal mid channel configured to receive the mandrel, the mandrel defining a mandrel upset, the top assembly lower face defines an upper receptacle for receiving a portion of the mandrel upper end, the mandrel passing through the passage of the piston assembly with the piston assembly slideably mounted about the mandrel at the piston assembly inner face, the lower portion defining a lower receptacle for receiving a portion of the mandrel lower end;

(iv) a hydraulic setting system in operable engagement with the upper and lower slip systems such that application of a predetermined hydraulic pressure to the system expands the at least one upper and lower slips laterally to a set position at a second average outer diameter that is greater than the first average outer diameter;

(v) a withdrawal system disposed within the body and configured such that application of a predetermined upward force on the elongated body when the at least one upper and lower slips are in the set position operably engages the upper slip systems to retract the at least one upper slip by shouldering the upper rod retainer against the mandrel upset, engaging the at least one upper slip with an upward and retracting force through the upper slip retainer, and the upper slip retainer shoulders against the upper rod engaging the at least one lower slip with an upward and retracting force through the lower slip retainer, so as to operably engage the lower slip system to retract the at least one lower slip, and wherein the at least one upper slip and at least one lower slip are retracted substantially sequentially.

2. The wellbore anchoring system of claim 1, wherein the at least one upper slip and the at least one lower slip are oriented laterally about the longitudinal axis at a relative offset.

3. The wellbore anchoring system of claim 1, wherein the at least one upper slip comprises three upper slips oriented about the longitudinal axis at about 120-degrees relative to each other, and the at least one lower slip comprises three lower slips oriented about the longitudinal axis at about 120-degrees relative to each other.

4. The wellbore anchoring system of claim 3, wherein the upper slips and lower slips are oriented about the longitudinal axis at a relative offset of about 60-degrees.

5. The wellbore anchoring system of claim 1, wherein the at least one upper and lower slips further have a T-shaped member, the elongated body defines a T-shaped slot corresponding to each slip T-shaped member, and further wherein the T-shaped members of the at least one upper and lower slips are disposed within the T-shaped slot such that the at least one upper and lower slips are slideably engaged with the body.

6. A wellbore anchoring system comprising:

a body elongated along a central longitudinal axis having an upper end and a lower end, the body defining an average outer surface at a first average outer diameter, the body further comprising:

(i) an upper portion, a lower portion, and a mid portion, an upper slip system comprising at least one upper slip, a lower slip system comprising at least one lower slip;

(ii) the upper portion comprises a top subassembly with a top subassembly upper face, a top subassembly lower face, and the upper portion defines an internal upper channel running longitudinally and open to the top subassembly upper and lower faces;

(iii) the mid portion having a mid portion longitudinal length, the mid portion comprising an upper rod retainer, an upper rod, lower rod retainer, a lower rod, the mid portion having a mid portion upper face, a mid portion lower face, and defining an internal mid channel running longitudinally and open to the mid portion upper and lower face;

(iv) the lower portion comprises a piston assembly, a sleeve, and a bottom subassembly, the piston assembly disposed within and in longitudinal slidable relation to the sleeve, having a piston assembly upper face, a lower face, and an inner face defining a passage into an inner chamber defined by the lower portion, the lower portion further defining an internal lower channel running longitudinally;

(v) a mandrel having a mandrel upper end and a mandrel lower end, a mandrel longitudinal length greater than the mid portion longitudinal length, the internal mid channel configured to receive the mandrel, the mandrel further defining an internal mandrel channel running longitudinally and open to the mandrel upper and lower faces;

(vi) the top assembly lower face defines an upper receptacle for receiving a portion of the mandrel upper end with the internal top upper channel in fluid communication with the internal mandrel channel, the mandrel passing through the passage of the piston assembly with the piston assembly slideably mounted about the mandrel at the piston assembly inner face, the lower portion defining a lower receptacle for receiving a portion of the mandrel lower end with the internal lower channel in fluid communication with the internal mandrel channel; and (vii) a hydraulic setting system in operable engagement with the upper and lower slip systems such that application of a predetermined hydraulic pressure to the system expands the at least one upper and lower slips laterally to a set position at a second average outer diameter that is greater than the first average outer diameter;

(viii) the internal mandrel channel being in fluid communication with the inner chamber of the piston assembly, the elongated body configured such that application of a hydraulic fluid at a predetermined pressure within the internal upper channel, the internal mandrel channel, the internal lower channel, and the inner chamber, causes the piston assembly to move upwardly along the longitudinal axis relative to the bottom subassembly, so as to operably engage the mid portion such that the lower rod retainer moves upwardly reducing the mid portion longitudinal length and causing the upper rod retainer and lower rod to operably engage the upper slip system so as to expand the at least one upper slip laterally to a set position at the second outer diameter, and the upper rod to operably engage the lower slip system so as to expand the at least one lower slip laterally to a set position at the second outer diameter substantially simultaneously; and (ix) a withdrawal system disposed within the body and configured such that application of a predetermined upward force on the elongated body when the at least one upper and lower slips are in the set position operably engages the upper slip system to retract the at least one upper slip and operably engages the lower slip system to retract the at least one lower slip, and wherein the at least one upper slip and at least one lower slip are retracted substantially sequentially.

7. The wellbore anchoring system of claim 6, wherein:

the lower portion comprises a ratchet ring operably engaged with the piston assembly and configured such that when the at least one upper slip and at least one lower slip are in the set position, the ratchet ring locks the elongated body in position.

8. The wellbore anchoring system of claim 6, wherein the lower subassembly defines a remotely activated port in fluid communication with the internal lower channel.

9. The wellbore anchoring system of claim 6, further comprising an upper slip body engaged with a lower rod, a lower slip body engaged with a lower rod retainer, wherein the at least one upper and lower slips further have a T-shaped member; and further wherein the upper slip retainer, the upper body, the lower slip retainer, and the lower slip body define a T-shaped slot corresponding to each slip T-shaped member with the T-shaped members of the at least one upper and lower slips disposed within the T-shaped slot such that the at least one upper and lower slips are slideably engaged with the body.

10. A wellbore anchoring system comprising:

a body elongated along a central longitudinal axis having an upper end and a lower end, the body comprises an upper portion, a lower portion, and a mid portion, the body defining an average outer surface at a first average outer diameter, wherein (i) the upper portion comprises a top subassembly with a top subassembly upper face, a top subassembly lower face, and the upper portion defines an internal upper channel running longitudinally and open to the top subassembly upper and lower faces;

(ii) the mid portion defines a mid portion longitudinal length, the mid portion comprising an upper rod retainer, an upper slip retainer, an upper rod, at least one upper slip, at least one lower slip, a lower slip retainer, a lower rod retainer, a lower rod, the mid portion having a mid portion upper face, a mid portion lower face, and defining an internal mid channel running longitudinally and open to the mid portion upper and lower face;

(iii) the lower portion comprises a piston assembly, a sleeve, and a bottom subassembly, the piston assembly disposed within and in longitudinal slidable relation to the sleeve, having a piston assembly upper face, a lower face, and an inner face defining a passage into an inner chamber defined by the lower portion, the lower portion further defining an internal lower channel running longitudinally;

(iv) a mandrel having a mandrel upper end and a mandrel lower end, a mandrel longitudinal length greater than the mid portion longitudinal length, the internal mid channel configured to receive the mandrel, the mandrel defining an internal mandrel channel running longitudinally and open to the mandrel upper and lower faces, and the mandrel further defining a mandrel upset;

(v) the top assembly lower face defines an upper receptacle for receiving a portion of the mandrel upper end with the internal top upper channel in fluid communication with the internal mandrel channel, the mandrel passing through the passage of the piston assembly with the piston assembly slideably mounted about the mandrel at the piston assembly inner face, the lower portion defining a lower receptacle for receiving a portion of the mandrel lower end with the internal lower channel in fluid communication with the internal mandrel channel;

(vi) the internal mandrel channel being in fluid communication with the inner chamber of the piston assembly, the elongated body configured such that application of a hydraulic fluid at a predetermined pressure within the internal upper channel, the internal mandrel channel, the internal lower channel, and the inner chamber, operably causes the piston assembly to move upwardly along the longitudinal axis relative to the bottom subassembly, so as to operably engage the mid portion such that the lower rod retainer moves upwardly reducing the mid portion longitudinal length and causing the upper rod retainer and lower rod to operably engage the upper slip system so as to expand the at least one upper slip laterally to a set position at a second outer diameter, and the upper rod to operably engage the lower slip system so as to expand the at least one lower slip laterally to a set position at the second outer diameter substantially simultaneously, wherein the second average outer diameter that is greater than the first average outer diameter; and (vii) wherein the body is configured such that an application of a predetermined upward force to the body, when the at least one slips are in the set position, shoulders the upper rod retainer against the mandrel upset, engaging the at least one upper slip with an upward and retracting force through the upper slip retainer, the upper slip retainer shoulders against the upper rod engaging the at least one lower slip with an upward and retracting force through the lower slip retainer, so as to retract the at least one upper slip and at least one lower slip are substantially sequentially.

11. The wellbore anchoring system of claim 10, wherein the at least one upper slip and the at least one lower slip are oriented laterally about the longitudinal axis at a relative offset.

12. The wellbore anchoring system of claim 10, wherein the at least one upper slip comprises three upper slips oriented about the longitudinal axis at about 120-degrees relative to each other, and the at least one lower slip comprises three lower slips oriented about the longitudinal axis at about 120-degrees relative to each other.

13. The wellbore anchoring system of claim 12, wherein the upper slips and lower slips are oriented about the longitudinal axis at a relative offset of about 60-degrees.

14. The wellbore anchoring system of claim 10, wherein the at least one upper and lower slips further have a T-shaped member, the elongated body defines a T-shaped slot corresponding to each slip T-shaped member, and further wherein the T-shaped members of the at least one upper and lower slips are disposed within the T-shaped slot such that the at least one upper and lower slips are slideably engaged with the body.

15. The wellbore anchoring system of claim 10, wherein:

the lower portion comprises a ratchet ring operably engaged with the piston assembly and configured such that when the at least one upper slip and at least one lower slip are in the set position, the ratchet ring locks the elongated body in position.

16. The wellbore anchoring system of claim 10, wherein the lower subassembly defines a remotely activated port in fluid communication with the internal lower channel.

17. The wellbore anchoring system of claim 10, further comprising an upper slip body engaged with a lower rod, a lower slip body engaged with a lower rid retainer, wherein the at least one upper and lower slips further have a T-shaped member; and further wherein the upper slip retainer, the upper body, the lower slip retainer, and the lower slip body define a T-shaped slot corresponding to each slip T-shaped member with the T-shaped members of the at least one upper and lower slips disposed within the T-shaped slot such that the at least one upper and lower slips are slideably engaged with the body.

* * * * *